United States Patent [19]

Buttner

[11] 3,980,312

[45] Sept. 14, 1976

[54] SKI CONTAINING A COATING STRIP ON ITS SLIDING SURFACE

[76] Inventor: Franz Buttner, Haus Gada, Dischmastrasse, CH-7270 Davos-Dorf, Switzerland

[22] Filed: Jan. 29, 1975

[21] Appl. No.: 545,170

[30] Foreign Application Priority Data

Jan. 31, 1974 Switzerland ..... 1319/74
Dec. 23, 1974 Switzerland ..... 17429/74

[52] U.S. Cl. ..... 280/610; 280/604
[51] Int. Cl.[2] ..... A63C 5/04; A63C 7/02
[58] Field of Search ..... 280/11.13 Y, 11.13 D, 280/11.13 E, 11.13 J, 11.13V, 11.13 T, 11.13 L, 11.13 R, 11.37 E, 11.37 G, 11.13 S

[56] References Cited

UNITED STATES PATENTS

| | | | |
|---|---|---|---|
| 2,142,459 | 1/1939 | Sahy | 280/11.13 Y |
| 3,276,784 | 10/1966 | Anderson, Jr. | 280/11.13 L |
| 3,520,546 | 7/1970 | Joseph | 280/11.13 R |
| 3,567,237 | 3/1971 | Miller, III | 280/11.13 T |

FOREIGN PATENTS OR APPLICATIONS

| | | | |
|---|---|---|---|
| 1,803,836 | 5/1970 | Germany | 280/11.13 L |
| 961,335 | 3/1957 | Germany | 280/11.13 Y |
| 89,238 | 3/1957 | Norway | 280/11.13 Y |

*Primary Examiner*—M. H. Wood, Jr.
*Assistant Examiner*—David M. Mitchell
*Attorney, Agent, or Firm*—Birch, Stewart, Kolasch & Birch

[57] ABSTRACT

A ski comprising at least one coating strip applied to at least a portion of its sliding surface, wherein at least a part of the coating strip is interchangeable, said coating strip being removably affixed to the underside of the ski.

13 Claims, 10 Drawing Figures

FIG. 6
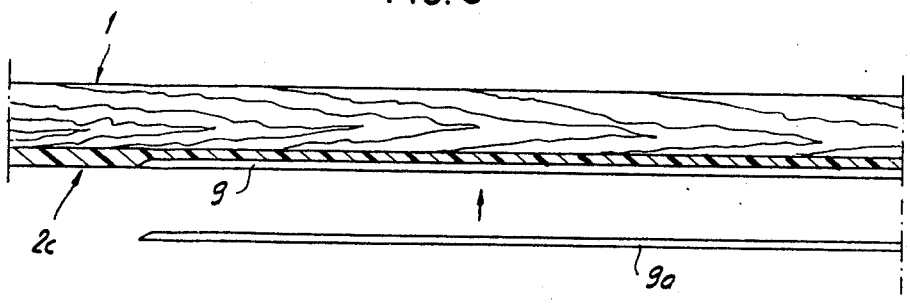
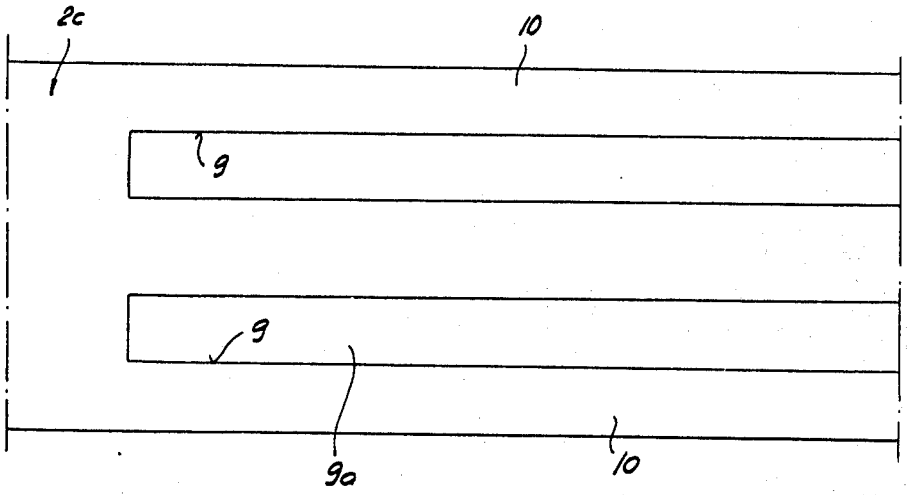
FIG. 7

SKI CONTAINING A COATING STRIP ON ITS SLIDING SURFACE

BACKGROUND AND SUMMARY OF THE INVENTION

The present invention is directed to a ski comprising a coating on its sliding surface. More particularly, the present invention is concerned with a coating strip which can be removably affixed to the sliding surface of a ski for facilitating its sliding and/or breaking effect.

It is general practice to provide a special coating on the sliding surfaces of skis. Coatings are known both in the form of permanent coatings, for example, plastic coatings, and also in the form of wax coatings which must be applied from time to time by the user. These coatings are not only used to generally improve the sliding properties of the skis (or the backward braking properties in the case of cross country skis) when compared with the sliding properties of non-coated skis, but also, these coatings adapt the sliding properties to the different snow or trail conditions. Permanent coatings naturally have the advantage that they only need to be replaced after a more lengthy period of use, but they can only be replaced by a specialist and they also represent only a compromise since they cannot fully take into account all of the different snow conditions which may arise. However, the waxing which has heretofore provided most adaptability is not only awkward and time consuming to apply, but it should also only be carried out directly before using the skis and requires a certain amount of expertise and skill.

The object of the present invention is to obviate the above disadvantages and to provide a ski containing a coating on its sliding surface wherein at least part of the coating is interchangeable and accordingly, is removably affixed to the underside of the ski. Coating strips which are self-adhesive on one side and are provided on their other side with a sliding surface, for example, a wax layer, have proved to be especially advantageous. Thus, it is possible for the user of the skis to select, from an assortment of strips, the coating strip which appears to have the most suitable friction surface or wax layer depending on the snow conditions, and he can attach this coating strip to the underside of the ski. An adhesive strip which can be affixed in this way can always be removed and replaced by another new strip or by a different type of strip or waxed band. The strip can consist of a plastic foil or a paper foil impregnated by saturation. Under certain snow conditions suitable unwaxed coating strips can be used. The friction coating may be in the form of an individual strip extending over part of or over the entire width of the ski and/or length of the ski. Alternatively, the coating strips may be in the form of two strips disposed, for example, on both sides of the guide groove of the skis or spaced apart from each other in series, lengthwise of the ski. The underside of the ski obviously requires no special preparation for affixing the coating strip, although it may be advantageous for the coating strip, which will be about 0.2 to 3 mm in thickness, to be arranged flush with the underside of the ski in a corresponding recess provided in the under surface of the ski. In the case of an embodiment which is especially advantageous for cross country skiing, the coating strip which consists of a plastic material is about 1 – 3 mm in thickness and covers the entire underside of the ski. A coating of this thickness is sufficiently stable because it does not have to be torn sideways, and accordingly, it does not need to be arranged in a recess. To provide the ski with the necessary lateral guidance in the case where conventional narrow central grooves are completely covered by the coating strip, the coating itself can be provided with a relatively broad recess which can extend, for example, to within a few millimeters of the lateral edges of the skis and which is about 0.1 to 0.4 mm in depth. This recess can extend at least over slightly more than the length of the binding on the underside of the ski. A broad, shallow guide groove of this nature which is disposed at least under the part of the ski comprising the binding on which the skier stands provides reliable lateral guidance even on the generally, relatively hard-packed cross country course since the bearing surfaces of the ski at the sides of the groove are relatively narrow and thus also penetrate the hard snow without difficulty. This groove can also be used to receive wax.

A wax layer can obviously be applied as required to the interchangeable coating affixed to the ski or, alternatively, it can itself be removably affixed thereto. In the case of cross country skis, the coating strip can also be provided with a sliding surface comprising studs, ridges or scales. The studs or ridges which project beyond the sliding surface and are advantageously in the form of plastic strips or bands acting as gripping agents to prevent backward sliding, are removably inserted or secured by adhesion in grooves of corresponding width in the sliding surface coating.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 6 is a longitudinal sectional view of a ski comprising another embodiment of the coating strip;

FIG. 7 is a plan view of the coating section according to FIG. 6;

DESCRIPTION OF THE PREFERRED EMBODIMENTS

Figure 1:
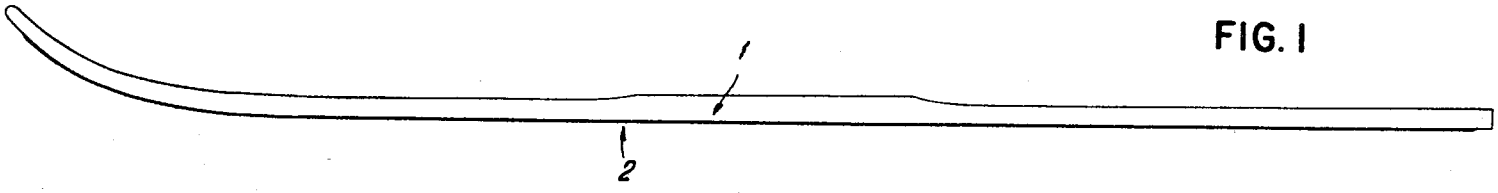
FIG. 1 is a side view of a ski according to the present invention.
Figure 2:
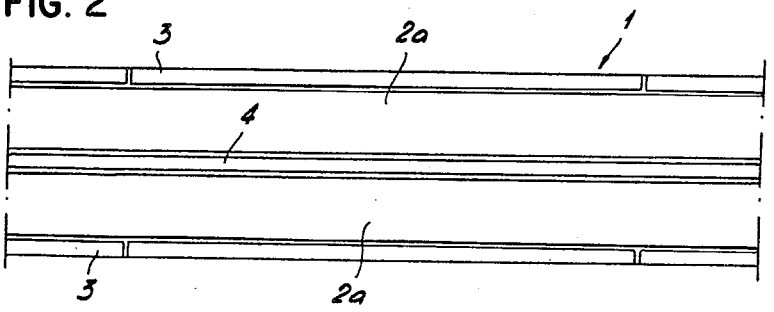
FIG. 2 shows the underside of the ski comprising a first embodiment of the coating strip.

A foil form coating strip 2 extending practically over the entire length of the ski is removably affixed to the underside of the ski 1 shown in FIG. 1. According to FIGS. 2 and 3, this coating consists of two longitudinal strips 2*a* which cover the underside of the ski between the particular insert edge 3 (metal or plastic) and the guide groove 4 provided in the longitudinal central region of the ski. Each strip 2*a* consists of a plastic foil or oil impregnated paper 6 which is rendered self-adhesive on one side by means of an adhesive layer 5 and which is provided with a wax layer 7 on its other side. Each of these strips 2*a* is disposed in a corresponding groove 8 in the underside of the ski in such a way that the wax surface of the strip 2*a* is practically flush with the sliding surface of the ski. This prevents the strips from being dislodged as a result of lateral forces and prevents their edges from being rapidly worn down or being torn.

Figure 3:
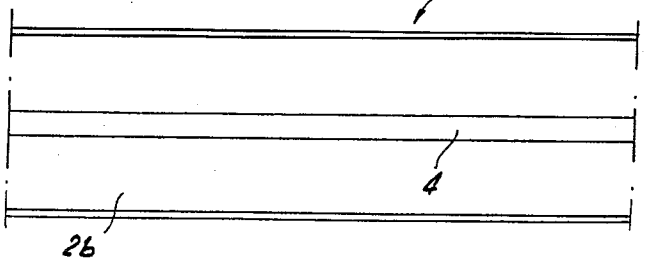
FIG. 3 represents the underside of the ski according to FIG. 2 showing another embodiment of the coating.
Figure 4:
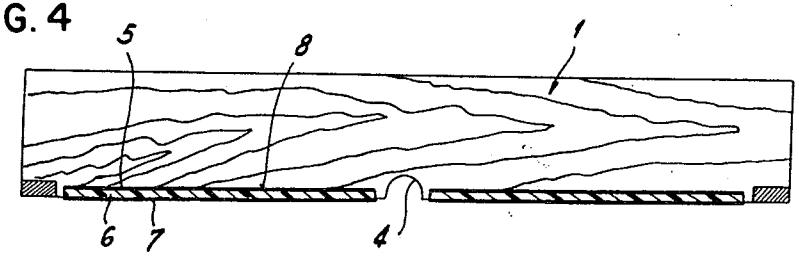
FIG. 4 is an enlarged scale view of a section through the ski according to FIG. 2.
Figure 5:
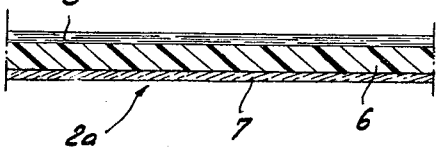
FIG. 5 is an enlarged scale view of a self-adhesive coating strip.

In the embodiment represented in FIG. 3, the coating consists of a single foil 2*b* extending virtually over the entire width of the ski and possessing one self-adhesive side and one waxed side. The foil 2*b* also follows the recessed guide groove.

In all cases it is essential that the coating foil is removably affixed to the underside of the ski and thus can easily be exchanged or replaced at any time. Quite obviously, the adhesive layer 5 which is applied directly to the coating foil, thus making the foil a self-adhesive strip, can also be replaced by a self-adhesive band of known design, which is adhesive on both sides.

The coating strip which has been described is simple and inexpensive to produce. A strip of desired length can be purchased and stored in roll form and can be coated with any desired type of wax, even wax for cross country skiing. The application and removal of the coating can be effected easily and rapidly by anyone. Snow conditions premitting, non-waxed plastic coating foils or foils which have lost their wax coating through use can also be used. With a suitable adhesive it is obviously also possible to reuse the coating strip. It is also possible to take into account differing snow or travel conditions by using coating strips of differing width. The coatings suitable for different snow conditions may be differently colored, thus enabling the user to select the correct coating.

An interchangeable coating strip according to the embodiment shown in FIGS. 6 and 7 has proven especially advantageous for cross country skiing. This self-adhesive coating strip 2*c* which is removably applied to the underside of the ski consists of a plastic foil which has a thickness of about 0.5 to 3 mm, preferably about 1 mm in thickness. This relatively stiff plastic foil also covers the narrow guide groove of the skiis which is generally provided on the underside of the ski. This plastic foil strip itself is provided with two adjacent recesses 9 which are spaced apart from each other and located at least under the part of the ski where the bindings are located. Two or more such pairs of recesses are advantageously distributed over the length of the ski. Alternatively, a single relatively broad recess could be provided instead of one or more pairs of recesses. The recesses 9 extend on both sides to within a few millimeters of the longitudinal edges of the skis so that the total remaining bearing surface 10 is relatively narrow and can penetrate the snow even when the trail is hard, thus providing the ski with the necessary lateral guidance. If desired, the coating strip 2*c* can be covered with a suitable wax. In particular, it is possible to fill the recesses 9 with wax or apply a pre-waxed interchangeable adhesive strip. This embodiment has proved especially advantageous for cross country skiing as removable grooved or graduated insert strips consisting, for example, of plastic material such as indicated at 9*a*, can be inserted in the 25–40 cm long recesses 9. These wedge-shaped, backward sloping, studded or graduated insert strips which project above the coating strip 2*c* (a plurality of such graduations can be provided) form an effective brake to prevent backward sliding without adversely affecting the forward sliding porperties of the sliding surface. As the insert strips are relatively narrow, for example, about 10 to 15 mm in width and have parallel longitudinal edges, there tends to be very little backfilling with snow, such as occurs when terminating a braking action with conventional skis having sliding surfaces containing small projecting parts or containing graduations extending over the entire width of the ski. When the projecting parts or stepped edges are worn down, the insert strips 9*a* can be easily replaced. Interchangeable insert strips of this type can obviously also be directly inserted into the recesses in the underside of the ski, thus forming the removable part of the sliding surface of the ski. It has been found especially advantageous to provide insert strips containing a recess of about 0.2 and 0.5 mm which can be filled with a suitable wax. Self-adhesive plastic strips of this type which are adapted for insertion in the recesses 9 and in which the edge portion limiting the recess for receiving wax is flush with the remaining sliding surface of the ski or is in the form of a wedge-shaped sloping ridge, can easily be removed when the wax has been worn away to allow rewaxing and can easily be replaced by new strips.

Figure 8:
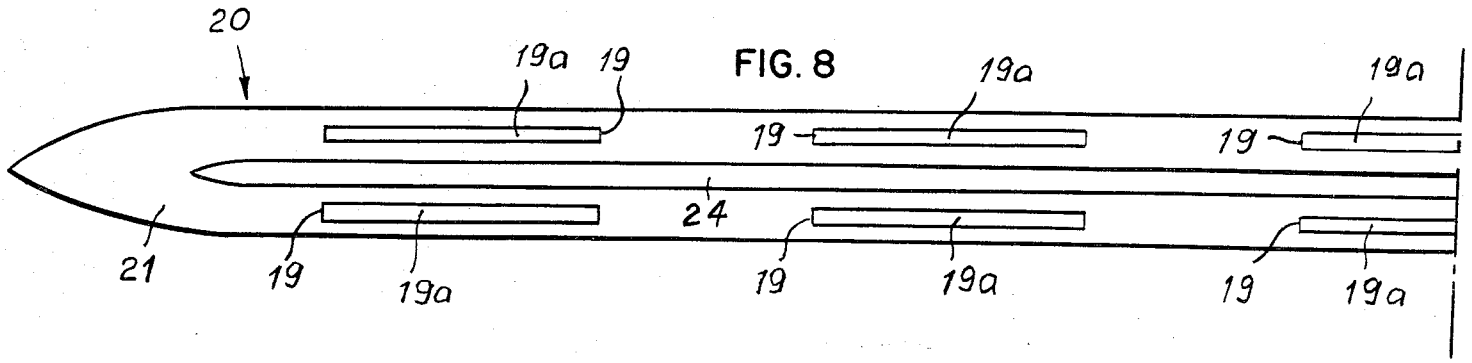
FIG. 8 is another view from below of another embodiment of a ski according to the present invention.

FIG. 8 shows the most advantageous embodiment of the present invention comprising three pairs of recesses 19 distributed over the length of the ski. These recesses 19 are provided on each side of a central guide groove 24 in a thin plastic sole 21 having a thickness of about 2 to 5 mm, which is secured to the underside of the ski 20, for example, by adhesion. Insert strips 19*a* are removably mounted in these recesses 19. The outer side of these strips 19*a* can contain a suitable wax layer or of a smooth surface layer or a surface layer containing recesses or projections. As this ski comprises three such pairs of strips 19*a*, the parts of the sliding surface formed by the pairs of strips can be provided with practically any desired combination of sliding or braking features. For example, all three pairs of strips can have identical or differing contact surfaces depending on the snow conditions or on the desired sliding or braking capacity of the skis.

Figure 9:
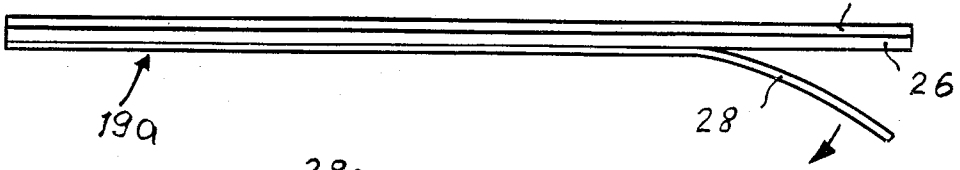
FIG. 9 is a side view of an insert strip for use with a ski as shown in FIG. 8.
Figure 10:
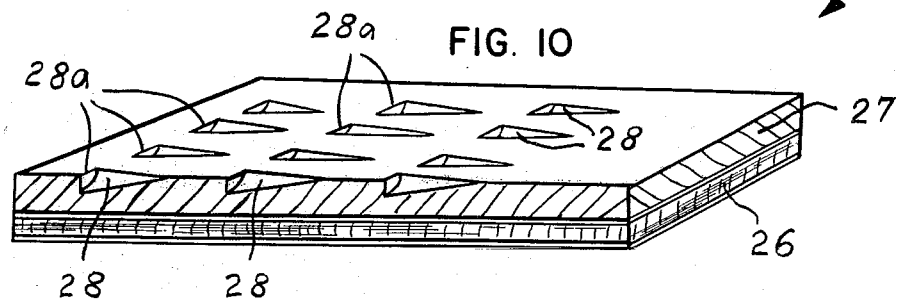
FIG. 10 is a diagrammatic view, on an enlarged scale, of a part of a strip according to FIG. 9.

FIGS. 9 and 10 represent embodiments of an insert strip 19*a* of this type. This strip is provided with a band 26 containing on both of its sides a self-adhesive surface. A plastic foil 27, for example, a low pressure polyethylene foil forming the sliding surface is affixed to one side and on the other side is affixed a covering sheet 28. The strip is sold in this form and can be stored by the user up to the time of use. When the strip is to be applied to the ski, the covering sheet 28 is removed from the self-adhesive band 26, as indicated in FIG. 9, and the strip is then affixed by the adhesive side, which is thus uncovered, in a recess 19 of the sole 21, from which the old strip has previously been removed.

FIG. 10 shows an embodiment of the configuration of the sliding surface 27. This surface can contain a plurality of recesses 28. About 10 to 100 or more such recesses may be provided per $cm^2$. It is important for these recesses to have a sharp front edge 28*a* and to taper off at the rear. These recesses which are approximately 0.5 mm in width and approximately 1 mm in length are preferably cut in the plastic foil by means of a tool comprising one or more appropriately shaped blades so as to produce a perfectly sharp edge 28*a*.

The sliding surface of the plastic foil 27 can obviously possess a different structure. For example, a plurality of parallel transverse grooves comprising sharp front edges or a plurality of irregular recesses produced, for example, by sand blasting, can be provided. The plurality of edges produce a perfect braking effect and as there are no parts projecting beyond the sliding surface of the ski, but only recesses, the forward properties of the skis are not impaired, or if so, only in a minimal way.

The invention being thus described, it will be obvious that the same may be varied in many ways. Such variations are not to be regarded as a departure from the spirit and scope of the invention, and all such modifications are intended to be included within the scope of the following claims.

I claim:

1. A ski comprising a coating strip fixed to the underside of the ski, said coating strip provided with a central guiding groove and at least one longitudinal recess disposed on each side of said central guiding groove, each of said recesses containing at least one interchangeable insert strip having an outer surface for contacting the surface over which the ski moves and having removable mounting means for selectively fixing said strip in said recess.

2. The ski of claim 1, wherein the coating strip is made of a plastic material.

3. The ski of claim 2, wherein the insert strip has a plastic coating on said outer surface thereof, and wherein said removable mounting means comprises an adhesive disposed on the inner surface of said insert strip, said insert strip being fixable in said recesses and removable from said recesses by pressure and pulling, respectively.

4. The ski of claim 3, wherein at least three longitudinal recesses are disposed on each side of the central guiding groove.

5. The ski of claim 2, wherein the coating strip has a thickness of about 1 to 3 mm.

6. The ski of claim 1, wherein the recesses have a depth of about 0.1 to 0.4 mm.

7. The ski of claim 2, wherein the outer surface of the insert strip has a smooth wax or plastic surface.

8. The ski of claim 1, wherein the outer surface of the insert strip contains a plurality of recesses or projections.

9. The ski of claim 8, wherein about 10 to 100 recesses per square centimeter are provided in the insert strip.

10. The ski of claim 8, wherein the recesses have a sharp front edge which tapers off at the rear of the recess.

11. The ski of claim 10, wherein the recesses have a width of about 0.5 mm and a length of about 1 mm.

12. The ski of claim 2, wherein the coating strip has a thickness of about 2 to 5 mm.

13. The ski of claim 1, wherein the coating strip is removably fixed to the underside of the ski.

* * * * *